United States Patent [19]

Greulich

[11] 4,102,102

[45] Jul. 25, 1978

[54] NONWELDED METAL GRATING

[76] Inventor: Thomas A. Greulich, 144 Spring House La., Pittsburgh, Pa. 15238

[21] Appl. No.: 816,027

[22] Filed: Jul. 15, 1977

[51] Int. Cl.[2] ..... E04B 5/18

[52] U.S. Cl. ..... 52/338; 404/70; 14/73; 52/668

[58] Field of Search ..... 404/36, 70; 14/73; 52/668, 669, 338, 327

[56] References Cited

U.S. PATENT DOCUMENTS

| | | | |
|---|---|---|---|
| 1,346,426 | 7/1920 | Scherbner | 52/668 X |
| 1,354,998 | 10/1920 | Paulson | 52/669 |
| 1,744,153 | 1/1930 | Bates | 52/668 X |
| 2,089,891 | 8/1937 | Greulich | 52/338 X |
| 2,112,949 | 4/1938 | Bunker | 52/338 X |
| 2,114,773 | 4/1938 | Anten | 52/338 X |
| 2,270,630 | 1/1942 | Greulich | 52/338 X |
| 2,319,468 | 5/1943 | Nagin | 52/669 X |
| 2,782,696 | 2/1957 | Francis | 52/668 |
| 2,834,267 | 5/1958 | Beebe | 52/668 X |
| 2,960,919 | 11/1960 | Nagin | 52/669 X |

*Primary Examiner*—Nile C. Byers

*Attorney, Agent, or Firm*—Brown, Flick & Peckham

[57] ABSTRACT

Each one of a plurality of parallel horizontal beams has longitudinally spaced vertical slots extending transversely through it, with the lower wall of each slot formed by the top of the free end portion of a tongue struck out of the beam. Resting on these tongues are parallel cross bars that extend through the slots and have notches extending downwardly from the tops of the bars receiving the portions of the beams above the slots, with those portions substantially engaging the bottoms of the notches. The height of the tongues is great enough to permit the bars during assembly to be inserted in the slots while the tongues are bent laterally out of the beams, whereupon the bars can be raised in the slots and the tongues bent back beneath the bars to support them.

2 Claims, 6 Drawing Figures

NONWELDED METAL GRATING

There are many patents on metal gratings for bridge floors and the like, but as far as I know all of such grating requires the grating bars to be welded together. Examples are shown in U.S. Pats. Nos. 2,740,335 and 3,057,272. Welding takes a considerable amount of time, which increases the cost of the grating. Also, if some of the welds fail, some of the bars may become loose or separate from the rest of the bars.

It is among the objects of this invention to provide a metal grating, in which none of the bars need to be welded to others, and in which the various members composing the grating can be quickly and easily assembled.

The preferred embodiment of the invention is illustrated in the accompanying drawings, in which.

Figure 1:
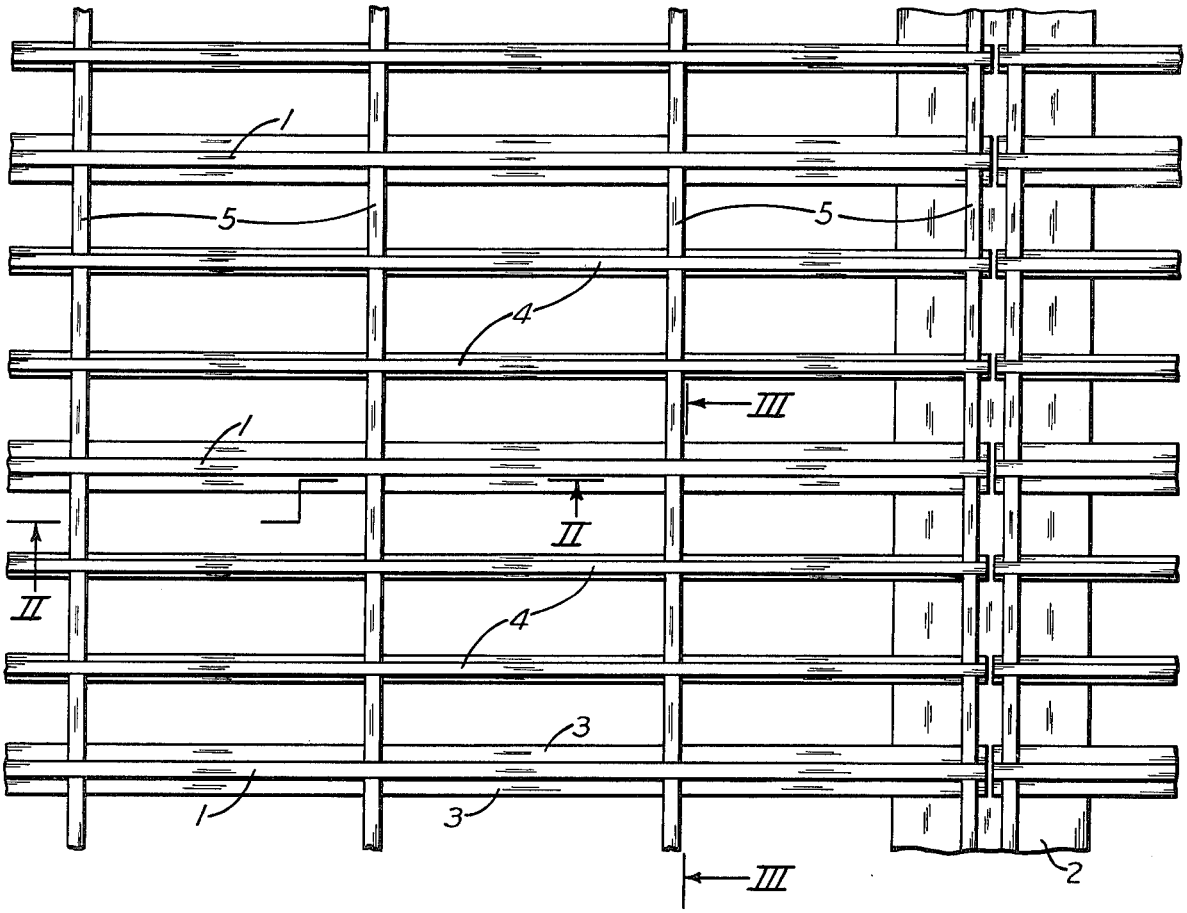
FIG. 1 is a fragmentary plan view of the grating.

Referring to FIG. 1 of the drawings, the grating for a bridge floor or the like is formed from a number of grating slabs, each of a size that can be conveniently transported to the site and readily handled. Each slab is formed from a plurality of parallel beams 1, the ends of which may be supported by bridge girders 2. Each beam has laterally projecting flanges 3 at its bottom so that it resembles an inverted T in cross section. There are smaller inverted T-bars 4 between the beams and parallel to them. Parallel cross bars 5 extend transversely of the beams and T-bars.

Figure 2:
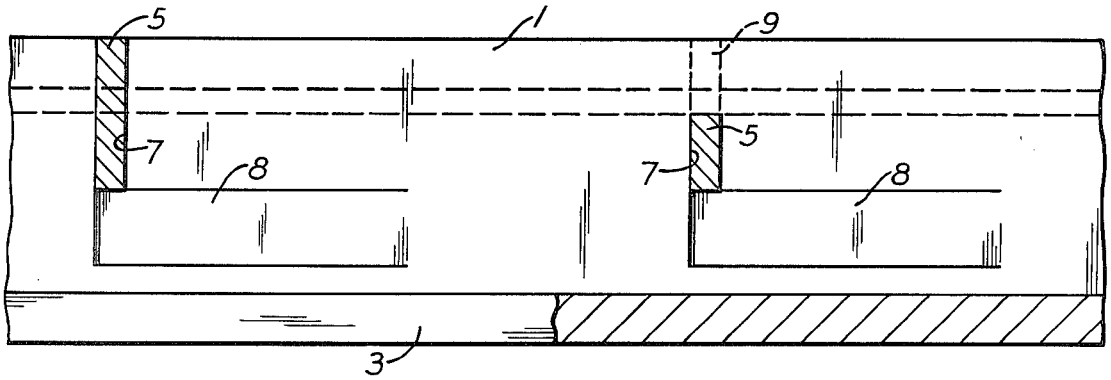
FIGS. 2 and 3 are enlarged vertical sections taken on the lines II—II and III—III, respectively, of FIG. 1.
Figure 3:
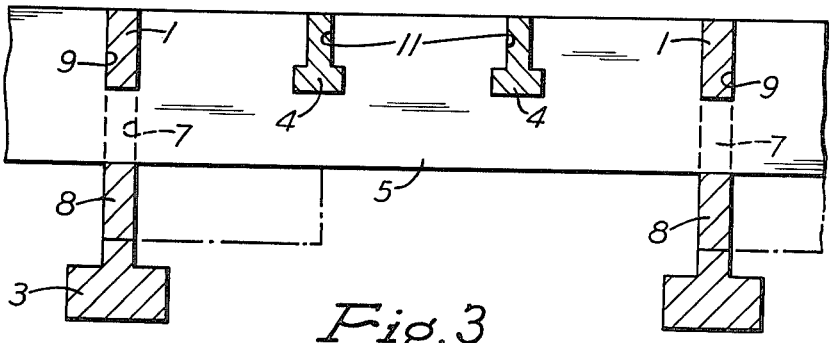
Figure 5:
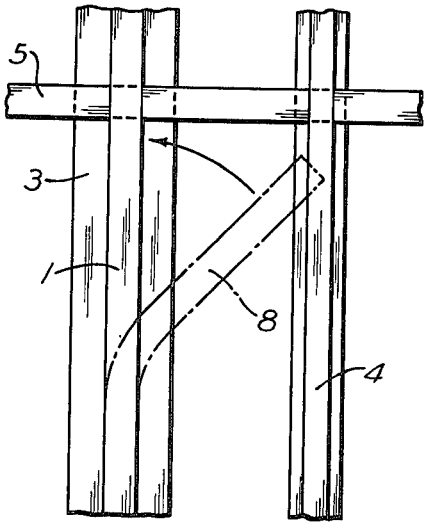
FIG. 5 is a fragmentary plan view showing that a tongue has been bent into place in a beam.
Figure 4:
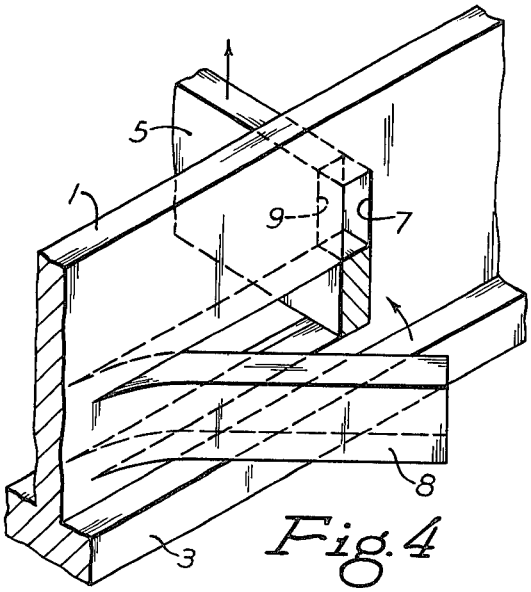
FIG. 4 is a perspective view showing a cross bar being assembled with a beam.

In accordance with this invention, each of the beams 1 has a plurality of longitudinally spaced vertical slots 7 extending transversely through it as shown in FIGS. 2, 3, and 4. The slots in each beam are aligned with the slots in the beams beside it. The lower wall of each slot is formed by the top of the free end portion of a tongue 8 struck out of the beam but lying in the plane of the beam. When the tongues are formed, they are bent laterally out of the beam as shown in FIG. 4 and indicated in broken lines in FIG. 5.

As shown in FIG. 4, the cross bars 5, which are rectangular and of greater height than the beam slots, are assembled with the beams by sliding the bars endwise through the slots and the open areas formed beneath the slots by the laterally bent tongues. The height of the tongues is great enough to permit this manner of assembly. The height of each bar is approximately equal to the beam opening in which it is inserted. Each bar is provided with notches 9 extending downwardly from its top as shown in FIGS. 3 and 4. These notches are the same distance apart as the beams so that the notches will be located in the beams slots. After the cross bars have been inserted in the beams as just described, the bars are raised to cause them to straddle the portions of the beams above the slots as shown in FIG. 3. The notches are of such depth that the bars can be raised far enough to permit the tongues to be bent back beneath them so that the tongues will support the bars. Preferably, the notches extend about halfway through the cross bars. With the notched bars in their raised position, the bottoms of their notches engage the bottoms of the portions of the beams in the notches. The tongues lock the cross bars and beams together. The tops of the bars preferably are substantially flush with the tops of the beams.

Each of the cross bars has inverted T-slots 11 extending downwardly from its top between each adjacent pair of beams. These T-slots receive the T-bars 4, which are inserted endwise into all of the aligned slots.

Figure 6:
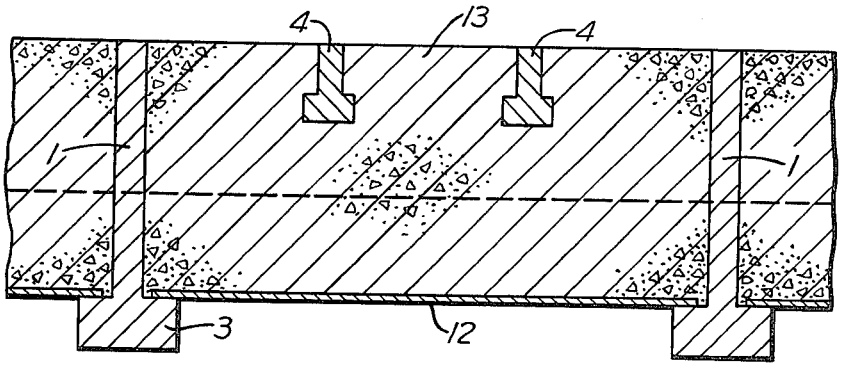
FIG. 6 is a view similar to FIG. 3 but showing the grating filled with concrete.

After the grating has been made in this way without requiring any welding and has been installed on the bridge, metal sheets or pans 12 may be placed on the beam flanges 3 to span the spaces between the beams as shown in FIG. 6. Then concrete 13 is poured onto the pans to fill the spaces between the beams above the pans. Consequently, the beams, cross-bars and T-bars are embedded in the concrete, and the grating becomes a very solid and stable floor slab.

Due to the lack of welding, the manufacturer can assemble the grating quite rapidly with unskilled labor, thereby holding down its cost. Yet, the metal members forming the grating are locked together and cannot separate in use.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A metal grating comprising a plurality of parallel horizontal beams provided with laterally projecting flanges, each beam having a plurality of longitudinally spaced vertical slots extending transversely therethrough, the lower wall of each slot being formed by the top of the free end portion of a tongue struck out of the beam, parallel cross bars of greater height than said slots extending through the slots and resting on the tongues and having notches extending downwardly from the tops of the bars receiving the portions of said beams above said slots with said portions substantially engaging the bottoms of the notches, the height of said tongues being great enough to permit the bars during assembly to be inserted in said slots while the tongues are bent laterally out of the beams, whereupon the bars can be raised in the slots and the tongues bent back beneath the bars to support them, pans resting on said beam flanges and spanning the spaces between the beams, and concrete resting on said pans and filling all of the space between said beams and bars to embed them in the concrete with the top of the concrete substantially flush with the tops of the beams.

2. A metal grating according to claim 1, in which said notches extend vertically about halfway through the bars, each of said cross bars has an inverted T-slot extending downwardly from the top of the bar between each adjacent pair of said beams, said grating including inverted T-bars extending through said T-slots with the tops of the T-bars substantially flush with the tops of the cross bars and concrete.

* * * * *